US005079117A

United States Patent [19]

Koyama et al.

[11] Patent Number: 5,079,117

[45] Date of Patent: Jan. 7, 1992

[54] ELECTROPHOTOGRAPHIC PHOTOSENSITIVE MEMBER WITH ELECTRICAL CONDUCTOR CONTAINING POLYETHER-POLYURETHANE LAYER

[75] Inventors: Takashi Koyama; Hideki Anayama, both of Yokahama; Yuichi Hashimoto, Tokyo; Noriko Hirayama, Tokyo; Kiyoshi Sakai, Tokyo; Teigo Sakakibara, Tokyo; Naoto Fujimura, Yokohama; Shoji Amamiya, Sagamihara, all of Japan

[73] Assignee: Canon Kabushiki Kaisha, Tokyo, Japan

[21] Appl. No.: 512,257

[22] Filed: Apr. 20, 1990

[30] Foreign Application Priority Data

Apr. 20, 1989 [JP] Japan ..... 1-102240

[51] Int. Cl.[5] ..... G03G 5/047; G03G 5/14

[52] U.S. Cl. ..... 430/58; 430/59; 430/62; 430/63; 358/300; 358/302

[58] Field of Search ..... 430/58, 65, 62, 63

[56] References Cited

U.S. PATENT DOCUMENTS

| | | | |
|---|---|---|---|
| 4,390,609 | 6/1983 | Wiedemann | 430/58 |
| 4,740,439 | 4/1988 | Tachikawa et al. | 430/56 X |
| 4,783,376 | 4/1988 | Sakaki et al. | 428/511 |
| 4,863,822 | 9/1989 | Fukagai et al. | 430/58 |
| 4,921,769 | 5/1990 | Yuh et al. | 430/64 |

FOREIGN PATENT DOCUMENTS

| | | | |
|---|---|---|---|
| 51-126149 | 11/1976 | Japan . | |
| 52-20836 | 2/1977 | Japan . | |
| 52-25638 | 2/1977 | Japan . | |
| 52-100240 | 8/1977 | Japan . | |
| 53-48623 | 5/1978 | Japan . | |
| 54-26738 | 2/1979 | Japan . | |
| 55-143564 | 11/1980 | Japan . | |
| 56-60448 | 5/1981 | Japan . | |
| 57-90639 | 6/1982 | Japan . | |
| 58-106549 | 6/1983 | Japan . | |
| 163346 | 7/1986 | Japan | 430/60 |
| 62-115467 | 5/1987 | Japan . | |
| 280862 | 12/1987 | Japan | 430/60 |

*Primary Examiner*—Roland Martin

*Attorney, Agent, or Firm*—Fitzpatrick, Cella, Harper & Scinto

[57] ABSTRACT

An electrophotographic photosensitive member has a photosensitive layer provided on an electroconductive support with interposition of an intermediate layer, the intermediate layer containing a polyether-polyurethane and an electroconductive substance.

An electrophotographic apparatus, comprises an electrophotographic photosensitive member having a photosensitive layer provided on an electroconductive support with interposition of an intermediate layer, the intermediate layer containing a polyether-polyurethane and an electroconductive substance.

A facsimile apparatus comprises an electrophotographic apparatus and a receiving means for receiving image information from a remote terminal, the electrophotographic apparatus comprising an electrophotographic photosensitive member having a photosensitive layer provided on an electroconductive support with interposition of an intermediate layer, the intermediate layer containing a polyether-polyurethane and an electroconductive substance.

10 Claims, 1 Drawing Sheet

ELECTROPHOTOGRAPHIC PHOTOSENSITIVE MEMBER WITH ELECTRICAL CONDUCTOR CONTAINING POLYETHER-POLYURETHANE LAYER

BACKGROUND OF THE INVENTION

1. Field of the Invention

The present invention relates to an electrophotographic photosensitive member. More particularly, the present invention relates to an electrophotographic photosensitive member which has an intermediate layer interposed between an electroconductive support and a photosensitive layer.

2. Related Background Art

In a Carlson type electrophotographic photosensitive member, generally the stability of dark-portion potential and light-portion potential is of great importance in order to form images with a constant image density and without a defect in repeated charging and exposure.

To improve the stability, it is suggested to provide, between a support and a photosensitive layer, an intermediate layer which functions to improve the ability of charge injection from the support to the photosensitive layer, to improve adhesion between the support and the photosensitive layer, to improve coating characteristics of the photosensitive layer, and so on.

In recent year, a variety of "function-separation type photosensitive members" are reported in which the photosensitive layer has a lamination structure comprising a charge generation layer and a charge transport layer. In such photosensitive members, the charge generation layer is usually made in a form of an extremely thin layer, for example, in a thickness of about 0.5 μm. The irregularity of the film thickness relates closely to non-uniformity of the sensitivity of the photosensitive member. Some of the major causes of the irregularity of the film thickness are a defect, a scratch, or soiling on the surface of the support. Accordingly, an intermediate layer is considered to be highly necessary.

As the layer provided between the photosensitive layer and the support, heretofore known are polyamides (JP-A-46-47344, JP-A-52-25638) (The term "JP-A" as used herein means "unexamined laid-open Japanese patent application"), polyesters (JP-A-52-20836, JP-A-54-26738), casein (JP-A-55-103556), polypeptides (JP-A-53-48523), polyvinyl alcohols (JP-A-52-100240), polyvinylpyrrolidones (JP-A-48-30936), vinyl acetate-ethylene copolymers (JP-A-48-26141), maleic anhydride ester polymers (JP-A-52-10138), polyvinylbutyrals (JP-A-57-90639, JP-A-58-106549), quaternary-ammonium-containing polymers (JP-A-51-126149, JP-A-56-60448), ethylcellulose (JP-A-55-143564), and so on.

However, in the photosensitive member which employs such a material as the intermediate layer, its potential is liable to be affected by temperature and humidity of the environment, whereby constantly stable potential characteristics and image quality could not always be attained owing to the dependency on environmental conditions.

For example, in the case where the photosensitive member is used repeatedly in an electrophotographic apparatus of positive development type at a low temperature and a low humidity, the intermediate layer comes to have a high resistance, and the light portion potential and the residual potential are made to rise and fogging occurs in the copied image because of residual electric charge remaining in the intermediate layer. On the other hand, in the case where such a photosensitive member is used in an electrophotographic printer of a reversal development type, problems arise that the image density is low and a constant density of the image cannot easily be attained.

On the contrary, at a high temperature and a high humidity, the intermediate layer comes to have an inferior barrier function owing to decrease of resistance, and carrier injection from the support side and decrease of dark portion potential are caused. Consequently, in an electrophotographic apparatus of positive development type, the density of the copied image becomes lower at a higher temperature and a higher humidity, while in a printer of a reversal development type electrophotography employing such a photosensitive member, a problem arises that image is liable to have black-spot defect and fogging.

In particular, in an electrophotographic photosensitive member of a lamination type in which the photosensitive layer is formed by sequentially laminating a charge generation layer and a charge transport layer, the potential is liable to become lower owing to increase of carrier injection from the support side, and slight lowering of barrier function of the intermediate layer tends to cause fogging in printers of reversal development type, because the charge generation layer containing a charge-generating substance in a high concentration is placed in contact with the intermediate layer.

To solve such problems, intermediate layers are reported which comprise a dispersion system of an electroconductive powdery material in a relatively highly resistant binder resin, such as an electroconductive powdery material in a polyester-polyurethane (JP-A-61-163346), titanium (IV) oxide or Sn (II) oxide in an acryl-polyurethane (JP-A-62-280863), carbon black in acryl polyol isocyanate (JP-A-62-115467), etc. In such systems, the variation of characteristics caused by variation of temperature and humidity can be decreased. However, in the system, a resin portion of high resistance and a powder portion of high conductivity are mingled, which raises problems, in reversal development type printers, that the charge injection from the support side to the photosensitive layer is liable to become non-uniform, and the potential tends to fall in a minute portion, and thereby black-spot defects in an image are caused.

Further, in repetitive use of the photosensitive member employing such an intermediate layer, at a higher processing speed of the electrophotographic process, electric charge accumulates disadvantageously at the resin portion of high resistance. Then, there is the problem that the residual potential is raised.

SUMMARY OF THE INVENTION

One object of the present invention is to provide an electrophotographic photosensitive member which will give stable potential characteristics and stable image over a broad range of environmental conditions from low temperature and low humidity to high temperature and high humidity.

Another object of the present invention is to provide an electrophotographic photosensitive member which exhibits less variation of light portion potential and dark portion potential even in repetitive use.

A further object of the present invention is to provide an electrophotographic photosensitive member which gives a defectless satisfactory image by formation of an intermediate layer capable of covering sufficiently any defect on a support.

According to the present invention, there is provided an electrophotographic photosensitive member having a photosensitive layer provided on an electroconductive support with interposition of an intermediate layer, the intermediate layer containing a polyether-polyurethane and an electroconductive substance.

According to the present invention, there is further provided an electrophotographic photosensitive member having a photosensitive layer provided on an electroconductive support with interposition of an intermediate layer, the intermediate layer containing a polyether-polyurethane and an electroconductive substance.

According to the present invention, there is still further provided a facsimile apparatus comprising an electrophotographic apparatus and a receiving means for receiving image information from a remote terminal, the electrophotographic apparatus comprising an electrophotographic photosensitive member having a photosensitive layer provided on an electroconductive support with interposition of an intermediate layer, the intermediate layer containing a polyether-polyurethane and an electroconductive substance.

DETAILED DESCRIPTION OF THE PREFERRED EMBODIMENT

Figure 1:
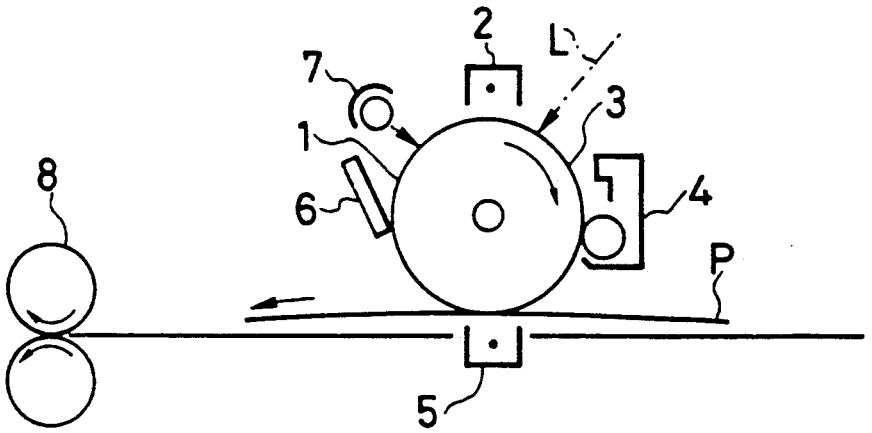
FIG. 1 illustrate a constitution of an electrophotographic apparatus employing the electrophotographic photosensitive member of the present invention.

The polyether-polyurethane employed in the present invention is a polymer prepared by polymerization or copolymerization of a polyether-polyol compound with an isocyanate compound.

The polyether polyol used as a starting material include poly(oxyalkylene) glycol such as poly(oxypropylene) glycol, poly(oxypropylene)-poly(oxyethylene) glycol, poly(oxybutylene) glycol, poly(oxytetramethylene) glycol, and the like; poly(oxyalkylene) triols such as poly(oxyethylene) triol, poly(oxypropylene) triol, poly(oxypropylene)-poly(oxyethylene) triol, poly(oxybutylene) triol, and the like; poly(oxyalkylene) polyols such as poly(oxypropylene) polyol, poly(oxypropylene)-poly(oxyethylene) polyol, and the like which are inititated by ethylenediamine, pentaerythritol, sorbitol, sucrose, starch, etc., and so on.

The isocyanate compounds used in the present invention include aromatic isocyanate compounds such as tolylene diisocyanate, meta-xylene diisocyanate, diphenylmethane diisocyanate, polymethylene-polyphenylene isocyanate, and the like; hydrogenated products of the above-mentioned isocyanates; aliphatic isocyanate compounds such as hexamethylene diisocyanate; blocked isocyanate compounds prepared by blocking the isocyanate group of the above-mentioned isocyanate compounds with a phenol, a ketoxime, an aromatic secondary amine, a tertiary alcohol, an amide, a lactam, a heterocyclic compound, a sulfite salt, or the like.

The above-mentioned isocyanate compounds may be in a form of from a dimer to a pentamer.

A catalyst may be added to accelerate polymerization of the above isocyanate compound with the isocyanate compound to form a polyether-polyurethane. The catalysts include naphthenate salts such as cobalt naphthenate, magnesium naphthenate, and the like; tin compounds such as dibutyltin dilaurate, dimethytin dilaurate, stannous chloride, and the like; amine compounds such as triethylenediamine, N-methylmorpholine, N,N,N',N'-tetramethylpolymethylenediamine, and the like; etc. The catalyst added is preferably in an amount within the range of from 0.001 to 5% by weight of the polymer.

On the other hand, the electroconductive substances used in the intermediate layer of the present invention include powdery metal, scale-like powdery metal, and short metal fiber of such as aluminum, copper, nickel, silver, and the like; electroconductive metal oxides such as antimony oxide, indium oxide, tin oxide, and the like; electroconductive polymers such as polyvinyl, polyaniline, polythiophene, polymer electrolytes, and the like; carbon fiber, carbon black, and graphite powder; organic and inorganic electrolytes; metal complexes; electroconductive powdery materials coated on the surface with the above-mentioned electroconductive substance.

The mixing ratio of the electroconductive substance to the resin is in the range of from 5:1 to 1:5, preferably from 4:1 to 1:3, which is decided in consideration of the resistance, surface properties, and coating suitability of the intermediate layer.

In the case where the electroconductive substance is powdery, the mixture may be prepared in a conventional manner by using a ball mill, a roll mill, a sand mill, or the like.

Other additives may be added such as a surfactant, a silane coupling agent, a titanate coupling agent, a silicone oil, a silicone leveling agent and the like.

The intermediate layer of the present invention may be formed by dissolving or dispersing a polymer derived from a polyol compound and an isocyanate compound in a suitable solvent, applying it on a support and then drying it, or otherwise by dissolving or dispersing a mixture of an unreacted polyol compound and an unreacted isocyanate compound, or a prepolymer composed of a partially reacted polyol and isocyanate compound together with an electroconductive substance in a suitable solvent, applying it on a support and then reacting it to cure.

The thickness of the intermediate layer is decided in consideration of the defect such as a scratch and a bruise on the surface of the support, and electrophotographic properties, and is generally in the range of from 0.1 to 50 μm, preferably from 1 to 30 μm.

The coating of the intermediate layer may be conducted by dip coating, spray coating, roll coating, or the like.

Additionally, a second intermediate layer mainly composed of a resin may be provided on the intermediate layer in the present invention, if necessary, for controlling the barrier properties or other purposes.

The resin materials useful for the second intermediate layer are exemplified by polyamides, polyurethanes, polyureas, polyesters, phenol resins, and the like.

The second intermediate layer has a thickness preferably in the range of from 0.1 μm to 5 μm, and is applied in the same manner as in the above-mentioned intermediate layer.

The photosensitive layer in the present invention may be of a lamination structure type having a charge generation layer and a charge transport layer separated functionally, or otherwise of a single layer type.

In the case of a lamination structure type photosensitive member, the charge generation layer may be formed by dispersing a charge-generating substance, for example, azo pigments such as Sudan Red, Dian Blue, etc.; quinone pigments such as pyrene quinone, anthanthrone, etc.; quinocyanine pigments, perylene pigments, indigo pigments such as indigo, thioindigo, etc.; azulenium salt pigments; phthalocyanine pigments such as copper phthalocyanine, titanyloxophthalocyanine, etc.; and the like, into a binder resin such as polyvinylformals, polyvinylbutyrals, polycarbonates, polystyrenes, polyvinyl acetates, acrylic resins, polyvinylpyrrolidones, ethylcelluloses, cellulose acetates and the like, and then applying this liquid dispersion on to the above-mentioned intermediate layer. The charge generation layer has a thickness of not more than 5 μm, preferably within the range of from 0.05 to 2 μm.

The charge transport layer on the charge generation layer may be formed by employing a coating solution prepared by dissolving, in a film forming resin as necessary, a charge transport substance such as an aromatic polycyclic compound having a structure of biphenylene, anthracene, pyrene, phenanthrene, or the like in the main chain or a side chain; a nitrogen-containing cyclic compound, e.g., indole, carbazole, oxadiazole, pyrazoline, etc., a styryl compound, or the like.

Such film-forming resins include polyesters, polycarbonates, polymethacrylate esters, polystyrenes, and the like.

The charge transport layer has a thickness of from 5 to 40, preferably from 10 to 30 μm.

The lamination structure type photosensitive member may have a structure such that a charge generation layer is laminated onto a charge transport layer.

The single-layer type photosensitive member may be formed by incorporating the above-mentioned charge generating substance and the charge transporting substance into the resin.

Further, an organic photoconductive polymer like polyvinylcarbazole, polyvinylanthracene, etc., a vapor-deposited selenium layer, a vapor-deposited selenium-tellurium layer, an amorphous silicone layer, or the like may be employed as the photosensitive layer in the present invention.

On the photosensitive layer, a protective layer may be provided which is composed of a resin layer or a resin layer containing an electroconductive pigment dispersed therein.

The electroconductive support employed in the present invention may be of any material which has electroconductivity, including a drum-shaped or sheet-shaped molded metal such as of aluminum, copper, molybdenum, chromium, nickel, brass and the like; a plastic film having a metal foil such as aluminum and copper laminated thereon; a plastic film having aluminum, indium oxide, tin oxide, or the like vapor-deposited thereon; the above-mentioned metal, plastic film or paper sheet having a electroconductive layer coated with an electroconductive substance singly or together with a suitable binder or the like.

The electrophotographic photosensitive member of the present invention is applicable to electrophotographic apparatuses such as copying machines, laser beam printers, LED printers, LCD printer (printers of liquid crystal shutter type), and microreader printers, and furthermore, it also applicable widely to apparatuses for displaying, recording, simple printing, engraving, facsimile, and the like which employ electrophotographic techniques.

FIG. 1 illustrates an outline of construction of an exemplary electrophotographic apparatus employing a drum type photosensitive member of the present invention.

In FIG. 1, the numeral 1 denotes a drum type photosensitive member as an image carrier which is driven to rotate around the axis 1*a* in a direction indicated by an arrow at a predetermined peripheral velocity. The photosensitive member 1 is electrically charged uniformly to a predetermined positive or negative potential at the peripheral face by the action of a charging means 2, and subsequently receives light image exposure L (slit exposure, laser beam scanning exposure, or the like) from a image exposing means (not shown in the figure) in the exposure section 3. Thereby electrostatic latent images are successively formed on the peripheral surface of the photosensitive member in accordance with the exposed image.

The electrostatic latent image is then developed with a toner by a development means 4, the developed toner image being transferred successively by a transfer means 5 onto a transfer material P which is fed synchronously with the rotation of the photosensitive member 1 from a paper feed section (not shown in the figure) to the space between the photosensitive member 1 and a transfer means 5.

The transfer material P having received the transferred image is separated from the surface of the photosensitive member introduced into an image fixing means 8 to have the image fixed, and then sent out of the apparatus as a copied material.

After the image transfer, the toner remaining on the surface of the photosensitive member 1 is removed by a cleaning means 6, and the cleaned surface is used repeatedly for image formation.

As the charging means 2 for uniform charging of the photosensitive member 1, a corona charging apparatuses is employed generally. As the transfer means 5 also, a corona charging apparatus is generally employed.

The electrophotographic apparatus may be assembled from apparatus units of a plurality of the structural elements such as a photosensitive member, a developing means, and a cleaning means such that the units may be demountable from the main body of the apparatus. For example, the photosensitive member 1 and the cleaning means 6 is integrated into an apparatus unit which is mountable and demountable by a guiding means such as a rail of the main body of the apparatus. The aforementioned apparatus units may comprise a charging means and/or a developing means.

In the case where the electrophotographic apparatus is used as a copying machine or a printer, the image exposure L is provided as reflected light or transmitted light from an original, or otherwise provided by scanning of a laser beam, driving of a light emiting diode array, or driving of a liquid crystal shutter array in accordance with the signal made by read-out of an original.

Figure 2:
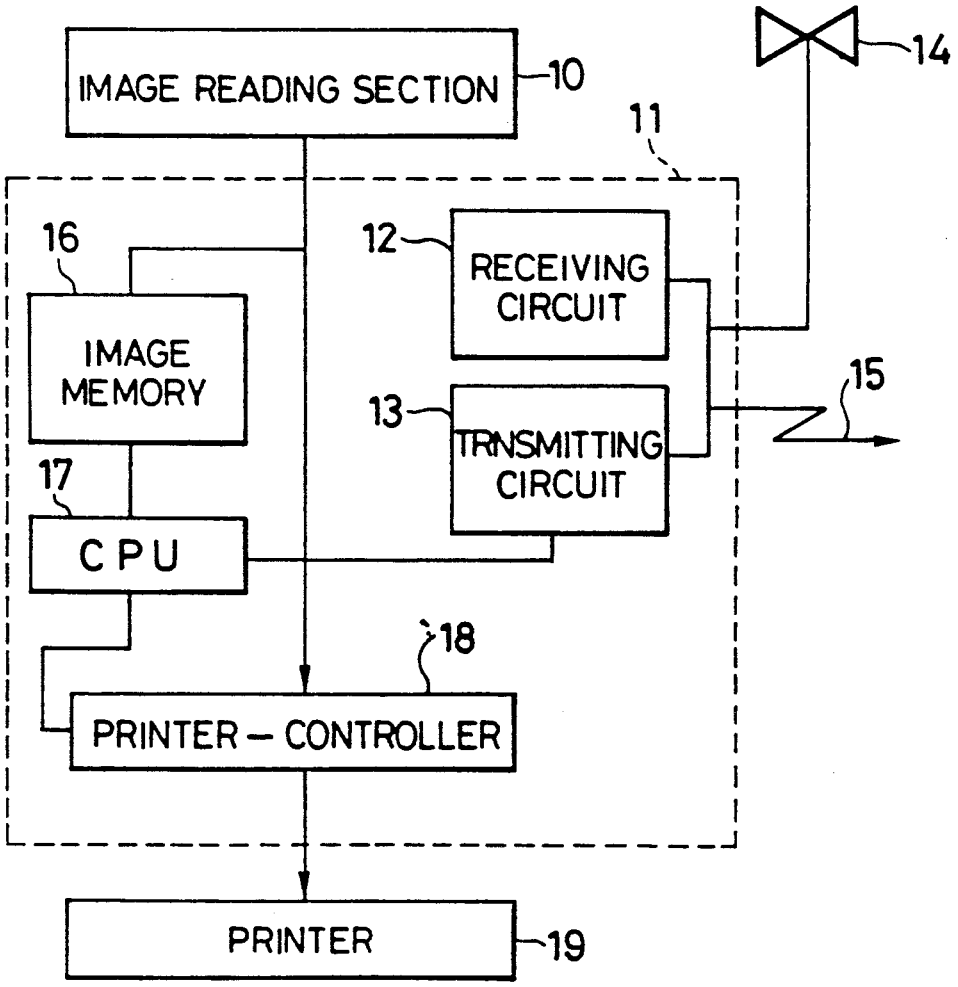
FIG. 2 is a block diagram of a facsimile apparatus comprising as a printer an electrophotographic apparatus employing an electrophotographic photosensitive member of the present invention.

In the case where the electrophotographic apparatus is used as a printer of a facsimile, the image exposure L prints out the received data. FIG. 2 shows a block diagram of an example for such a case.

A controller 11 controls an image reading section 10 and a printer 19. The whole of the controller 11 is controlled by CPU 17. The read-out data from the image reading section is transmitted to the other communication party through a transmitting circuit 13. Data received from the other communication party is sent to a printer 19 through a receiving circuit 12. The image data is stored in an image memory 16. A printer-controller 18 controls a printer 19. The numeral 14 denotes a telephone.

An image received through a circuit 15 (image information from a remote terminal connected through the circuit), after demodulated with the receiving circuit 12, is decoded by CPU 17 and successively stored in the image memory 16. When at least one page of image is stored in the image memory 16, recording of the image of the page is conducted. The CPU 17 reads out one page of image information from the image memory 16, and send out the decoded one page of image information to the printer controller 18 which controls a printer 19 to record the one page of image information on receiving the one page of image information from CPU 17.

The CPU 17 receives the following page during the recording by the printer 19.

Images are received and recorded in a manner as described above.

This invention is further illustrated by the following examples but it is to be understood that the scope of the invention is not to be limited thereby. Unless otherwise specified, all parts are by weight.

EXAMPLE 1

15 parts of scale-like powdery aluminum (average particle size: 3 μm), 6 parts of poly(oxypropylene) triol (hydroxyl value: 112 mgKOH/g), 1 part of hexamethylene diisocyanate, 0.0001 part of dibutyltin laurate, 15 parts of methyl ethyl ketone (MEK), and 15 parts of methyl isobutyl ketone (MIBK) were dispersed for 1 hour by means of a sand mill employing glass beads of 1 mm in diameter to prepare a paint for an intermediate layer.

The paint was applied onto an aluminum cylinder (30 mm diameter×260 mm) by dip coating, and cured at 160° C. for 30 minutes to form an intermediate layer of 10 μm thick.

Subsequently, 1 part of an alcohol-soluble nylon copolymer (weight-average molecular weight: 82,000) was dissolved in 24 parts of methanol. The solution was applied onto the aforementioned intermediate layer by dip coating, and dried at 80° C. for 10 minutes to form a second intermediate layer of 0.5 μm thick.

2 parts of the trisazo pigment of the structural formula below:

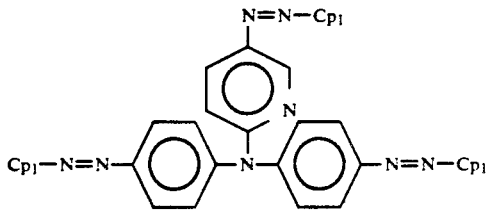

-continued

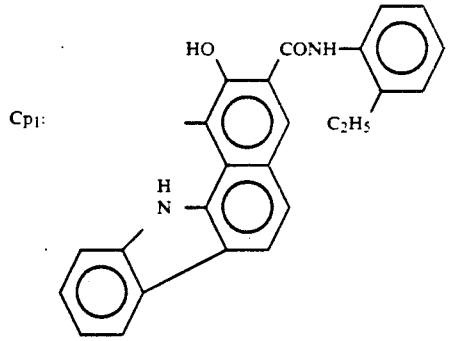

1 part of polymethyl methacrylate (weight-average molecular weight: 21,000), 30 parts of cyclohexanone were dispersed for 10 hours by a sand mill employing glass beads of 1 mm in diameter, and then 60 parts of MEK was added thereto to prepare a liquid dispersion for a charge generation layer. The liquid dispersion was applied onto the second intermediate layer by dip coating, and dried at 80° C. for 20 minutes to form a charge generation layer of 0.2 μm thick.

Subsequently, 1 part of a styryl compound of the structural formula below:

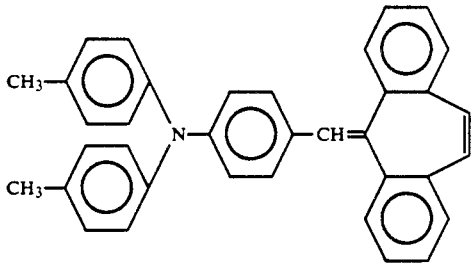

and 1 part of a polycarbonate (weight-average molecular weight: 54,000) were dissolved in a mixed solvent of 1 part of dichloromethane and 7 parts of monochlorobenzene to form a solution for a charge transport layer. The solution was applied onto the aforementioned charge generation layer by dip coating, and dried at 120° C. for 60 minutes to form a charge transport layer of 18 μm thick. Thus an electrophotographic photosensitive member was produced.

This electrophotographic photosensitive member was mounted on a laser beam printer of a reversal development type which repeats processes of charging, laser-exposing, transferring, and cleaning in 1.5-second cycle, and evaluated for electrophotographic characteristics at an ordinary temperature-humidity condition (21° C. and 55% RH) and a high temperature-humidity condition (32° C. and 85% RH).

As the results, the photosensitive member of Example 1 gave a large difference between the dark portion potential ($V_D$) and the light portion potential ($V_L$), giving sufficient potential contrast, and gave a satisfactory image without a black-spot defect and fogging as shown in Table 1.

EXAMPLE 2

10 parts of scale-like powdery aluminum used in Example 1, 2 parts of poly(oxyethylene) triol (hydroxyl value: 50 mgKOH/g), 3 parts of poly(oxypropylene)

glycol (hydroxy value: 35 mgKOH/g), 1 part of hexamethylene diisocyante blocked with ketoxime (effective isocyanate: 15% by weight). 0.0001 part of dibutyltin dilaurate, 15 parts of MEK, and 15 parts of MIBK were dispersed for 2 hours by means of a sand mill employing glass beads of 1 mm in diameter to prepare a paint for an intermediate layer.

An electrophotographic photosensitive member was prepared in the same manner as in Example 1 except that the paint prepared as above was used for the intermediate layer.

The photosensitive member was evaluated in the same manner as in Example 1. The dark portion potential ($V_D$) was stable even at a high temperature and a high humidity, and the image obtained was satisfactory without black-spot defect and fogging. The results are shown in Table 1.

COMPARATIVE EXAMPLES 1–4

2 parts of the scale-like powdery aluminum used in Example 1, 1 part of a resol type phenol resin, 5 parts of methanol, and 5 parts of methylcellosolve were dispersed for 2 hours by means of a sand mill employing glass beads of 1 mm in diameter to prepare a paint for an intermediate layer of Comparative example 1.

2 parts of the scale-like powdery aluminum used in Example 1, 1 part of polyvinylformal (weight-average molecular weight: 600, formalation degree: 75%), 3 parts of tetrahydrofuran (THF), and 10 parts of cyclohexanone were dispersed for 2 hours by means of a sand mill employing glass beads of 1 mm in diameter to prepare a paint for an intermediate layer of Comparative example 2.

15 parts of the scale-like powdery aluminum used in Example 1, 6 parts of acryl-polyol (hydroxyl value: 115 mgKOH/g), 1 part of hexamethylene diisocyanate, 0.0001 part of dibutyltin dilaurate, 20 parts of MEK, and 20 parts of MIBK were dispersed for 2 hours by means of a sand mill employing glass beads of 1 mm in diameter to prepare a paint for an intermediate layer of Comparative example 3.

15 parts of the scale-like powdery aluminum used in Example 1, 6 parts of polyester-triol (hydroxyl value: 102 mgKOH/g), 1 part of hexamethylene diisocyanate, 0.0001 part of dibutyltin dilaurate, 30 parts of MEK, and 10 parts of MIBK were dispersed for 2 hours by means of a sand mill employing glass beads of 1 mm in diameter to prepare a paint for an intermediate layer of Comparative example 4.

Electrophotographic photosensitive members were prepared in the same manner as in Example 1 except that the paints prepared as above were respectively used for the intermediate layers of Comparative examples 1–4, and were evaluated respectively in the same manner as in Example 1.

As the results, the photosensitive members of Comparative examples 1 and 2 gave high light-portion potentials ($V_L$) because of the insufficient sensitivity, giving insufficient potential contrast and thus giving low image density. At a high temperature and a high humidity, any of the photosensitive members of Comparative examples 1–4 caused image defects in a black spot form, which is assumed to be due to non-uniform charge injection.

The results are shown in Table 1.

EXAMPLES 3 AND 4, AND COMPARATIVE EXAMPLES 5–8

The electrophotographic photosensitive members of examples 3 and 4 and Comparative examples 5, 6, 7, and 8 were prepared in the same manner respectively as in Examples 1 and 2 and Comparative examples 1, 2, 3, and 4 except that electroconductive powdery tin (average particle size: 0.2 μm) was used for the electroconductive substance for the intermediate layers in place of the scale-like powdery aluminum.

The photosensitive members thus prepared were evaluated in the same manner as in Example 1. The photosensitive members of Examples 3 and 4 had stable potential characteristics both at ordinary temperature and humidity and at high temperature and high humidity, giving satisfactory image without defect.

On the contrary, the photosensitive member of Comparative examples 5 and 6 did not gave sufficient potential contrast due to insufficiency of the sensitivity, giving low image density. At high temperature and high humidity, the images of Comparative examples 5, 7, and 8 had black-spot defects, and the photosensitive member of Comparative example 6 gave a low dark-portion potential ($V_D$) with fogging over the whole image.

The results are shown in Table 1.

TABLE 1

| | Intermediate layer | | Normal temperature & normal humidity (21° C., 55% RH) | | | High temperature & high humidity (32° C., 85% RH) | | |
|---|---|---|---|---|---|---|---|---|
| Example No. | Electro-conductive substance | Binder resin | Dark-portion potential ($V_D$) [−V] | Light-portion potential ($V_L$) [−V] | Image | Dark-portion potential ($V_D$) [−V] | Light-portion potential ($V_L$) [−V] | Image |
| Example 1 | Scale-like powdery aluminum | polyether-polyurethane | 770 | 145 | Good | 750 | 140 | Good |
| Example 2 | Scale-like powdery aluminum | Polyether-polyurethane | 755 | 135 | Good | 740 | 125 | Good |
| Comparative example 1 | Scale-like powdery aluminum | Phenol resin | 745 | 280 | Density:low | 705 | 200 | Black-spot defect |
| Comparative example 2 | Scale-like powdery aluminum | Polyvinyl-formal | 770 | 305 | Density:low | 725 | 185 | Black-spot defect |
| Comparative example 3 | Scale-like powdery aluminum | Acryl-polyurethane | 760 | 150 | Good | 715 | 135 | Black-spot defect |
| Comparative example 4 | Scale-like powdery | Polyester-polyurethane | 765 | 145 | Good | 705 | 125 | Black-spot defect |

TABLE 1-continued

| Example No. | Intermediate layer: Electro-conductive substance | Intermediate layer: Binder resin | Normal temperature & normal humidity (21° C., 55% RH): Dark-portion potential ($V_D$) [−V] | Normal temperature & normal humidity: Light-portion potential ($V_L$) [−V] | Normal temperature & normal humidity: Image | High temperature & high humidity (32° C., 85% RH): Dark-portion potential ($V_D$) [−V] | High temperature & high humidity: Light-portion potential ($V_L$) [−V] | High temperature & high humidity: Image |
|---|---|---|---|---|---|---|---|---|
| Example 3 | aluminum Powdery tin oxide | Polyether-polyurethane | 755 | 130 | Good | 740 | 120 | Good |
| Example 4 | Powdery tin oxide | Polyether-polyurethane | 750 | 130 | Good | 735 | 115 | Good |
| Comparative example 5 | Powdery tin oxide | Phenol resin | 725 | 265 | Density:low | 695 | 190 | Black-spot defect |
| Comparative example 6 | Powdery tin oxide | Polyvinyl-formal | 740 | 275 | Density:low | 655 | 170 | Fogging wholly |
| Comparative example 7 | Powdery tin oxide | Acryl-polyurethane | 730 | 145 | Good | 705 | 130 | Black-spot defect |
| Comparative example 8 | Powdery tin oxide | Polyester-polyurethane | 750 | 150 | Good | 715 | 145 | Black-spot defect |

EXAMPLE 5

20 parts of powdery titanium oxide coated with tin oxide containing 8% antimony oxide; 8 parts of poly-(oxypropylene)-poly(oxyethylene) triol (copolymerization ratio of oxypropylene/oxyethylene: 8/2, hydroxyl value 65 mgKOH/g); 3 parts of ketoxime-blocked hexamethylene diisocyanate trimer (effective isocyanate: 12.5% by weight); 0.0002 part of dibutyltin dilaurate; 15 parts of MEK; and 15 parts of MIBK were dispersed for 3 hours by means of a sand mill employing glass beads of 1 mm in diameter to prepare a paint for an intermediate layer.

The paint was applied on to an aluminum cylinder (80 mm in diameter × 360 mm) by dip coating, and cured at 150° C. for 45 minutes to form an intermediate layer of 18 μm thick.

Subsequently, 1 part of alcohol-soluble nylon copolymer (weight-average molecular weight: 79,000), and 1 part of N-methoxymethylated 6-nylon (weight-average molecular weight: 25,000, methoxymethyl substitution degree: 29%) were dissolved in 25 parts of methanol. The solution was applied onto the aforementioned intermediate layer by dip coating, and dried at 90° C. for 10 minutes to form a second intermediate layer of 1.0 μm thick.

2 parts of the disazo pigment of the structural formula below:

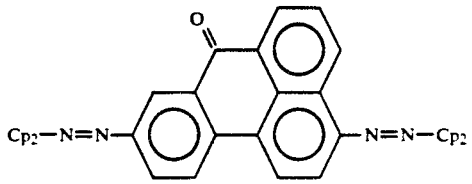

-continued

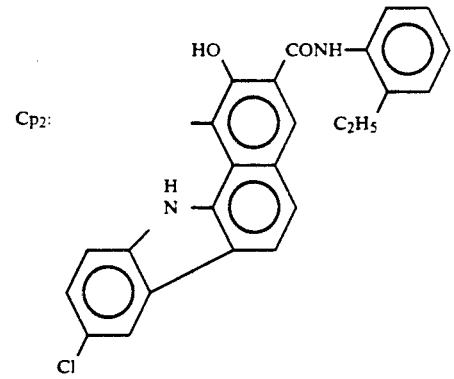

1 part of polyvinylbutyral (weight-average molecular weight: 22,000, butyralation degree: 70%), 15 parts of cyclohexanone, and 15 parts of THF were dispersed by a sand mill employing glass beads of 1 mm in diameter for 20 hours, and then 60 parts of THF was added thereto to prepare a liquid dispersion for a charge generation layer.

The liquid dispersion was applied onto the aforementioned second intermediate layer by dip coating, and dried at 80° C. for 10 minutes to form a charge generation layer of 0.15 μm thick.

Subsequently, 1 part of the styryl compound used in Example 1, and 1 part of polycarbonate (weight-average molecular weight: 47,000) were dissolved in a mixed solvent of 2 parts of dichloromethane and 6 parts of monochlorobenzene to form a solution for a charge transport layer. The solution was applied onto the aforementioned charge generation layer by dip coating, and dried at 125° C. for 60 minutes to form a charge transport layer of 15 μm thick. Thus an electrophotographic photosensitive member was prepared.

This electrophotographic photosensitive member was mounted on a laser beam printer of a reversal development type which repeats processes of charging, laser-exposing, transferring, and cleaning in 1.2-second cycle, and evaluated for electrophotographic characteristics at an ordinary temperature and ordinary humidity condition (22° C. and 50% RH) and a high temperature and high humidity condition (33° C. and 90% RH).

As the results, the photosensitive member of Example 5 gave a large difference between the dark portion potential ($V_D$) and the light portion potential ($V_L$), giving sufficient potential contrast, and gave a satisfactory image without a black-spot defect and fogging in both temperature-humidity conditions as shown in Table 2.

EXAMPLES 6-9

10 parts of powdery titanium oxide coated with tin oxide containing 11% antimony oxide, 10 parts of powdery rutile type titanium, 1 part of poly(oxypropylene) triol (hydroxyl value: 160 mgKOH/g), 8 parts of poly(oxyethylene) triol (hydroxyl value: 55 mgKOH/g), 1 part of meta-xylylene diisocyanate, 0.1 part of triethylenediamine, 25 parts of MEK, and 25 parts of MIBK was dispersed for 1 hour by means of a sand mill employing glass beads of 1 mm in diameter to prepare a paint for the intermediate layer of Example 6.

15 parts of powdery titanium oxide coated with antimony oxide-containing tin oxide used in Example 5, 1 part of poly(oxypropylene) polyol (initiated with pentaerythritol, hydroxyl value: 105 mgKOH/g), 6 parts of hydrogenated tolylene diisocyanate, 0.001 part of cobalt naphthenate, 20 parts of MEK, and 15 parts of MIBK were dispersed for 1.5 hours by means of a sand mill employing glass beads of 1 mm in diameter to prepare a paint for the intermediate layer of Example 7.

30 parts of powdery titanium oxide coated with antimony-oxide-containing tin oxide used in Example 5, 11 parts of poly(oxypropylene)-poly(oxyethylene) glycol (copolymerization ratio of oxypropylene/oxyethylene: 3/7, hydroxyl value: 30 mgKOH/g), 11 parts of hexamethylene diisocyanate trimer blocked by ketoxime (effective isocyanate: 12.5% by weight), 0.0002 parts of dibutyltin dilaurate, 2 parts of solvent-soluble polyether-polyurethane elastomer (weight-average molecular weight: 17,000), MEK 60 parts, and 60 parts of dimethylformamide (DMF) were dispersed for 1.5 hours by means of a sand mill employing glass beads of 1 mm in diameter to prepare a paint for the intermediate layer of Example 8.

The electrophotographic photosensitive members of Examples 6-8 were prepared respectively in the same manner as in Example 5 except that the intermediate layers for Examples 6-8 prepared as above were used.

The electrophotographic photosensitive member of Example 9 was prepared in the same manner as in Example 5 except that the second intermediate layer was not provided.

These photosensitive members were evaluated in the same manner as in Example 5. In any of the photosensitive members, the dark portion potential ($V_D$) was stable even at high temperature and high humidity, and the image obtained was satisfactory without black-spot defect and fogging. The results are shown in Table 2.

COMPARATIVE EXAMPLES 9-14

2 parts of titanium oxide coated with antimony-oxide-containing tin oxide, 1 part of resole type phenol resin, 4 parts of MEK, and 4 parts of methylcellosolve were dispersed for 3 hours by means of a sand mill employing glass beads of 1 mm in diameter to prepare the paint for the intermediate layer of Comparative example 9.

The paint for the intermediate layer of Comparative example 10 was prepared in the same manner as in Example 5 except that the poly(oxypropylene)-poly(oxyethylene) triol for the paint for the intermediate layer of Example 5 was replaced by acrylpolyol (hydroxyl value: 60 mgKOH/g).

The paint for the intermediate layer of Comparative example 11 was prepared in the same manner as in Example 5 except that the poly(oxypropylene)-poly(oxyethylene) triol for the paint for the intermediate layer of Example 5 was replaced by polyester triol (hydroxyl value: 55 mgKOH/g).

The paint for the intermediate layer of Comparative example 12 was prepared in the same manner as in Example 8 except that the poly(oxypropylene)-poly(oxyethylene) glycol used in Example 8 was replaced by polyester triol (hydroxyl value: 28 mgKOH/g) and the polyether-polyurethane elastomer was replaced by solvent-soluble polyester-polyurethane elastomer (weight-average molecular weight: 19,000).

The electrophotographic photosensitive members of Comparative examples of 9-12 were prepared respectively in the same manner as in Example 5 except that the paints for the intermediate layers for Comparative examples 9-12 were used.

The electrophotographic photosensitive members of Comparative examples 13 and 14 were prepared respectively in the same manner as in Comparative examples 9 and 10 except that the second intermediate layer was not provided.

These photosensitive members were evaluated in the same manner as in Example 5. The photosensitive member of Comparative example 9 had insufficient sensitivity and gave a high light portion potential ($V_L$), resulting in insufficient potential contrast and low image density. In Examples 13 and 14 where the second intermediate layer was not provided, charge injection from the support was excessively large, not giving sufficient dark portion potential ($V_D$), so that image could not be evaluated in the both cases. At high temperature and high humidity, on the other hand, any of the photosensitive members of Comparative examples 9-12 causes image defects of black spots, which are considered to be due to irregular charge injection. The results are shown in Table 2.

EXAMPLES 10 AND 11, AND COMPARATIVE EXAMPLES 15-18

The electrophotographic photosensitive members of Examples 10 and 11 and Comparative examples 15-18 were prepared respectively in the same manner as in Examples 5 and 8 and Comparative examples 9-12 except that powdery electroconductive carbon was used in place of the powdery titanium oxide coated with antimony-oxide-containing tin oxide as the electroconductive substance for the intermediate layer.

These photosensitive members were evaluated in the same manner as in Example 5. In Examples 10 and 11, defectless satisfactory images were obtained with stable potential characteristics both at ordinary temperature and ordinary humidity and at high temperature and high humidity.

The photosensitive member of Comparative example 15 gave an image of low density without sufficient potential contrast because of the insufficient sensitivity. At high temperature and high humidity, any of the photosensitive members of Comparative examples 15-18 caused image defects of black spots.

The results are shown in Table 2.

TABLE 2

| Example No. | Intermediate layer: Electro-conductive substance | Intermediate layer: Binder resin | Second Inter-mediate layer | Normal temperature & normal humidity (21° C., 55% RH): Dark-portion potential ($V_D$) [−V] | Normal temperature & normal humidity (21° C., 55% RH): Light-portion potential ($V_L$) [−V] | Normal temperature & normal humidity (21° C., 55% RH): Image | High temperature & high humidity (32° C., 85% RH): Dark-portion potential ($V_D$) [−V] | High temperature & high humidity (32° C., 85% RH): Light-portion potential ($V_L$) [−V] | High temperature & high humidity (32° C., 85% RH): Image |
|---|---|---|---|---|---|---|---|---|---|
| Example 5 | Titanium oxide coated with Sb-oxide-contg. tin oxide | Polyether-polyurethane | Provided | 680 | 135 | Good | 660 | 125 | Good |
| Example 6 | Titanium oxide coated with Sb-oxide-contg. tin oxide | Polyether-polyurethane | Provided | 660 | 140 | Good | 645 | 125 | Good |
| Example 7 | Titanium oxide coated with Sb-oxide-contg. tin oxide | Polyether-polyurethane | Provided | 685 | 130 | Good | 665 | 130 | Good |
| Example 8 | Titanium oxide coated with Sb-oxide-contg. tin oxide | Polyether-polyurethane | Provided | 675 | 135 | Good | 665 | 135 | Good |
| Example 9 | Titanium oxide coated with Sb-oxide-contg. tin oxide | Polyether-polyurethane | None | 660 | 115 | Good | 625 | 110 | Good |
| Comparative example 9 | Titanium oxide coated with Sb-oxide-contg. tin oxide | Phenol-resin | Provided | 670 | 280 | Density: low | 630 | 165 | Black-spot defect |
| Comparative example 10 | Titanium oxide coated with Sb-oxide-contg. tin oxide | Acryl-polyurethane | Provided | 685 | 145 | Good | 655 | 145 | Black-spot defect |
| Comparative example 11 | Titanium oxide coated with Sb-oxide-contg. tin oxide | Polyester polyurethane | Provided | 675 | 155 | Good | 650 | 140 | Black-spot defect |
| Comparative example 12 | Titanium oxide coated with Sb-oxide-contg. tin oxide | Polyester-polyurethane | Provided | 690 | 145 | Good | 650 | 130 | Black-spot defect |
| Comparative example 13 | Titanium oxide coated with Sb-oxide-contg. tin oxide | Phenol-resin | None | 385 | 90 | Failing | 350 | 75 | Failing |
| Comparative example 14 | Titanium oxide coated with Sb-oxide-contg. tin oxide | Acryl-polyurethane | None | 405 | 105 | Failing | 365 | 85 | Failing |
| Example 10 | Electro-conductive powdery carbon | Polyether-polyurethane | Provided | 675 | 135 | Good | 685 | 120 | Good |
| Example 11 | Electro-conductive powdery carbon | Polyether-polyurethane | Provided | 670 | 150 | Good | 665 | 140 | Good |
| Comparative example 15 | Electro-conductive powdery carbon | Phenol-resin | Provided | 645 | 270 | Density: low | 605 | 185 | Black-spot defect |
| Comparative example 16 | Electro-conductive powdery carbon | Acryl-polyurethane | Provided | 665 | 160 | Good | 660 | 140 | Black-spot defect |
| Comparative example 17 | Electro-conductive powdery carbon | Polyester polyurethane | Provided | 680 | 155 | Good | 645 | 155 | Black-spot defect |
| Comparative example 18 | Electro-conductive powdery carbon | Polyester-polyurethane | Provided | 660 | 135 | Good | 630 | 120 | Black-spot defect |

EXAMPLES 12 AND 13, AND COMPARATIVE EXAMPLES 19-22

2 parts of the disazo pigment of the structural formula below:

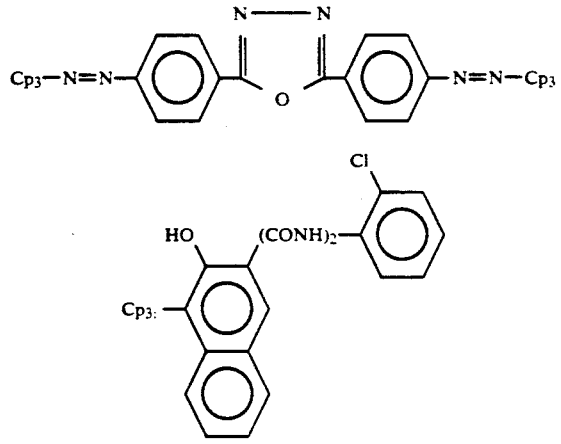

1 part of polyvinylbutyral (weight-average molecular weight: 17,000, butyralation degree: 71%), 15 parts of cyclohexanone, and 15 parts of THF were dispersed by a sand mill employing glass beads of 1 mm in diameter for 10 hours, and then 60 parts of THF was added thereto to prepare a liquid dispersion for a charge generation layer.

The electrophotographic photosensitive members of Examples 12 and 13 and Comparative examples 19-22 were prepared in the same manner as in Examples 5 and 8, and Comparative examples 9-12 respectively except that the liquid dispersions above were used for forming the charge generation layers.

These electrophotographic photosensitive members were mounted on a laser beam printer of a reversal developement type which repeats processes of charging, halogen-exposing, transferring, and cleaning in 0.6-second cycle.

These photosensitive members were evaluated for electrophotographic characteristics at low temperature and low humidity (12° C. and 15% RH).

As the results, the photosensitive members of Examples 12 and 13 gave sufficient potential contrast in the initial image formation, and thereafter gave quite stable images with little rise of the dark portion potential ($V_L$) during 1000 sheets of continuous image formation.

On the contrary, the photosensitive member of Comparative example 19 had insufficient sensitivity, not giving sufficient potential contrast, and causing fogging of the image from the initial stage. After continuous image formation of 1000 sheets, the light portion potential greatly rose and the fogging became more serious. The photosensitive members of Comparative examples 20-22, which initially gave satisfactory potential contrast, gave rise of light portion potential ($V_L$), and came to cause fogging during continuous 1000 sheets of image formation. The results are shown in Table 3.

EXAMPLES 14 AND 15, AND COMPARATIVE EXAMPLES 23-26

2 parts of disazo pigment of the structural formula below:

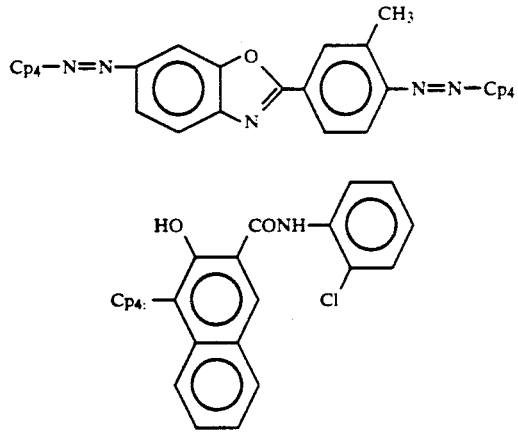

1 part of polymethyl methacrylate (weight-average molecular weight: 24,000), 30 parts of cyclohexanone were dispersed by means of a sand mill employing glass beads of 1 mm in diameter for 10 hours, and then 60 parts of THF were added thereto to prepare a liquid dispersion for a charge generation layer.

Separately, 1 part of the hydrazone compound of the structural formula below:

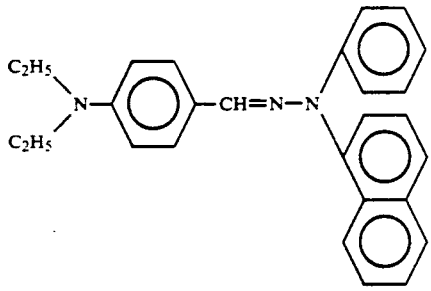

and 1 part of a polycarbonate (weight-average molecular weight: 54,000) were dissolved in a mixed solvent of 1 part of dichloromethane and 7 parts of monochlorobenzene to form a paint for a charge transport layer.

The electrophotographic photosensitive members of Examples 14 and 15 and Comparative examples 23-26 were prepared in the same manner as in Examples 5 and 8 and Comparative examples 9-12 respectively except that the paint for a charge generation layer and a paint for a charge transport layer prepared above were used.

The photosensitive members thus prepared were evaluated in the same manner as in Example 12.

As the results, the photosensitive members of Examples 14 and 15 gave sufficient potential contrast in the initial image formation, and thereafter gave quite stable images with little rise of the dark portion potential ($V_L$) during 1000 sheets of continuous image formation.

On the contrary, the photosensitive members of Comparative examples 23-26, which initially gave satisfactory potential contrast, gave rise of light portion potential ($V_L$), and came to cause fogging during continuous 1000 sheets of image formation. The results are shown in Table 3.

TABLE 3

| | (Measurement Environment: 12° C., 15% RH) | | | | | |
|---|---|---|---|---|---|---|
| | Intermediate layer | | Initial stage | | After 100-sheet copying | |
| Example No. | Electro-conductive substance | Binder resin | Dark-portion potential ($V_D$) [−V] | Light-portion potential ($V_L$) [−V] | Dark-portion potential ($V_D$) [−V] | Image |
| Example 12 | Titanium oxide coated with Sb-oxide-contg. tin oxide | Polyether-polyurethane | 655 | 185 | 195 | Good |
| Example 13 | Titanium oxide coated with Sb-oxide-contg. tin oxide | Polyether-polyurethane | 650 | 190 | 195 | Good |
| Comparative example 19 | Titanium oxide coated with Sb-oxide-contg. tin oxide | Phenol resin | 640 | 245 | 345 | Considerable fogging |
| Comparative example 20 | Titanium oxide coated with Sb-oxide-contg. tin oxide | Acryl-polyurethane | 645 | 175 | 265 | Fogging |
| Comparative example 21 | Titanium oxide coated with Sb-oxide-contg. tin oxide | Polyester-polyurethane | 660 | 180 | 280 | Fogging |
| Comparative example 22 | Titanium oxide coated with Sb-oxide-contg. tin oxide | Polyester-polyurethane | 665 | 195 | 290 | Fogging |
| Example 14 | Titanium oxide coated with Sb-oxide-contg. tin oxide | Polyether-polyurethane | 645 | 175 | 190 | Good |
| Example 15 | Titanium oxide coated with Sb-oxide-contg. tin oxide | Polyether-polyurethane | 655 | 170 | 200 | Good |
| Comparative example 23 | Titanium oxide coated with Sb-oxide-contg. tin oxide | Phenol resin | 660 | 200 | 305 | Fogging |
| Comparative example 24 | Titanium oxide coated with Sb-oxide-contg. tin oxide | Acryl-polyurethane | 655 | 165 | 270 | Fogging |
| Comparative example 25 | Titanium oxide coated with Sb-oxide-contg. tin oxide | Polyester-polyurethane | 630 | 165 | 255 | Fogging |
| Comparative example 26 | Titanium oxide coated with Sb-oxide-contg. tin oxide | Polyester-polyurethane | 640 | 160 | 275 | Fogging |

What is claimed is:

1. An electrophotographic photosensitive member having a photosensitive layer provided on an electroconductive support with interposition of an intermediate layer, the intermediate layer containing a polyether-polyurethane and an electroconductive substance.

2. The electrophotographic photosensitive member of claim 1, wherein the polyether-polyurethane is a polymer derived from a polyether-polyol compound and an isocyanate compound.

3. The electrophotographic photosensitive member of claim 1, wherein a second intermediate layer is provided between the intermediate layer and the photosensitive layer.

4. The electrophotographic photosensitive member of claim 1, wherein the photosensitive layer comprises an organic compound.

5. The electrophotographic photosensitive member of claim 1, wherein the photosensitive layer has a lamination structure constituted of at least a charge generation layer containing a charge-generating substance and a charge transport layer containing a charge-transporting substance.

6. The electrophotographic photosensitive member of claim 5, wherein the electrophotographic photosensitive member comprises at least an electroconductive support, an intermediate layer, a charge generation layer, and a charge transport layer, provided in this order.

7. The electrophotographic photosensitive member of claim 5, wherein the electrophotographic photosensitive member comprises at least an electroconductive support, an intermediate layer, a charge transport layer, and a charge generation layer, provided in this order.

8. The electrophotographic photosensitive member of claim 1, wherein the electrophotographic photosensitive member comprises at least an electroconductive support, an intermediate layer, a photosensitive layer, and a protective layer provided in this order.

9. An electrophotographic apparatus, comprising an electrophotographic photosensitive member having a photosensitive layer provided on an electroconductive support with interposition of an intermediate layer, the intermediate layer containing a polyether-polyurethane and an electroconductive substance.

10. A facsimile apparatus comprising an electrophotographic apparatus and a receiving means for receiving image information from a remote terminal, the electrophotographic apparatus comprising an electrophotographic photosensitive member having a photosensitive layer provided on an electroconductive support with interposition of an intermediate layer, the intermediate layer containing a polyether-polyurethane and an electroconductive substance.

* * * * *